US005199166A

United States Patent [19]

Torigai et al.

[11] Patent Number: 5,199,166

[45] Date of Patent: Apr. 6, 1993

[54] CYLINDER BLOCK OF AN ENGINE

[75] Inventors: Katsumi Torigai; Masanori Takahashi, both of Hamamatsu, Japan

[73] Assignee: Sanshin Kogyo Kabushiki Kaisha, Hamamatsu, Japan

[21] Appl. No.: 756,538

[22] Filed: Sep. 9, 1991

[30] Foreign Application Priority Data

Sep. 20, 1990 [JP] Japan ..... 2-248893

[51] Int. Cl.[5] ..... H01R 43/00; F01B 11/02

[52] U.S. Cl. ..... 29/888.061; 92/169.1; 123/193.2

[58] Field of Search ..... 29/888.06, 888.061; 123/41.84, 41.83, 193 C; 92/169.1, 169.2, 169.3, 169.4, 171.1

[56] References Cited

U.S. PATENT DOCUMENTS 1,775,358 9/1930 Smith ..... 92/169.1

5,050,549 9/1991 Takahashi ..... 29/888.061

FOREIGN PATENT DOCUMENTS 0070101 10/1915 Austria ..... 123/41.48

0234291 3/1986 Fed. Rep. of Germany ... 123/193 C 0080756 3/1989 Japan ..... 123/193 C 1-144454 10/1989 Japan .

0099118 9/1959 Norway ..... 123/41.84

*Primary Examiner*—Thomas E. Denion

*Attorney, Agent, or Firm*—Ernest A. Beutler

[57] ABSTRACT

A cylinder is provided for use in reciprocating machines. The cylinder has a wear resistant plating formed on its inner surface in such a way that the plating will not extend to the top end of the cylinder at the time the end surface of the cylinder is machined for final fit. Such placement of the plating ensures that this final machining step will not strip any plating material from the inner surface of the cylinder. The cylinder may be integral with the cylinder block or a liner for it.

8 Claims, 2 Drawing Sheets

CYLINDER BLOCK OF AN ENGINE

BACKGROUND OF THE INVENTION

This invention relates to a cylinder block of an engine, and more particularly to a liner positioned within a cylinder and a wear resistant plating employable with such a liner.

In many instances, reciprocating machines are formed from a cylinder block in which cylinders having liners are employed. Frequently, it is the practice to plate the inner surface of a cylinder liner with a more wear resistant material. When so plating a cylinder liner, the plating normally extends to the top and bottom ends of the liner. It is also the practice to machine at least the top end of the liner so that when it is placed in the cylinder block the liner surface will be flush with the top deck of the block. However, when the machining of the plated liner takes place, there is a danger that the plating may be stripped from the interior of the liner, or at least portions of it. This can give rise to obvious problems.

In earlier filed application Ser. No. 547,493, now U.S. Pat. No. 5,050,549 filed Jul. 3, 1990, assigned to the assignee hereof, the need for a cylinder liner employing a wear resistant plating material which would not be displaced upon machining of the liner was recognized. That application teaches a plating material formed upon a specially pre-formed cylinder surface. The cylinder surface is designed such that subsequent machining will not affect the integrity of the resistant plating. An advantage of the present invention over such a teaching, as will become apparent, relates to the elimination of the need for the preparation of a special cylinder surface prior to a plating step in which the wear resistant coating is deposited. As a result, a reduction in machining and costs may be realized.

It is, therefore, a principal object of this invention to provide an improved plated liner for a reciprocating machine.

It is further an object to provide a method of plating and machining a liner for a reciprocating machine that will insure that the plating does not become displaced during subsequent machining of the top surface of the liner.

It is yet another object of this invention to provide a wear resistant liner for a cylinder which does not require the prior formation of a special cylinder surface before forming a wear resistant material thereon.

SUMMARY OF THE INVENTION

A first feature of the invention is adapted to be embodied in a cylinder for a reciprocating machine. The cylinder comprises a cylinder and a cylindrical lining for the cylinder. The lining has an inner bore which, in turn, has a diameter which is constant along a substantial portion of the axial length of the lining. The inner bore, further, has a portion along an axial end of the lining which has a steadily increasing diameter running from a region along the one end of the cylinder up to the end of the cylinder. This end of the cylinder is machinable so that the top of the cylinder can be machined without disturbing the lining.

The invention is also adapted to be embodied in a method of making a lined cylinder for a reciprocating machine. The method comprises the steps of: forming a cylinder having an inner surface which comprises an inner bore; coating the inner bore of the cylinder with a wear resistant plating; and chamfering off an inner ridge of an upper end of the cylinder and coating in a manner to prevent removal of the coating upon machining of the upper end of the cylinder.

DETAILED DESCRIPTION OF THE PREFERRED EMBODIMENT

The invention is described below in conjunction with an internal combustion engine of an outboard motor for a watercraft. It is to be understood, however, that the invention may also be utilized in other contexts; for example, in other applications for reciprocatory engines, or in some form of rotary machines wherein there is provided a plated cylinder liner that has one of its ends machined so as to accommodate a sealing surface.

Figure 1:
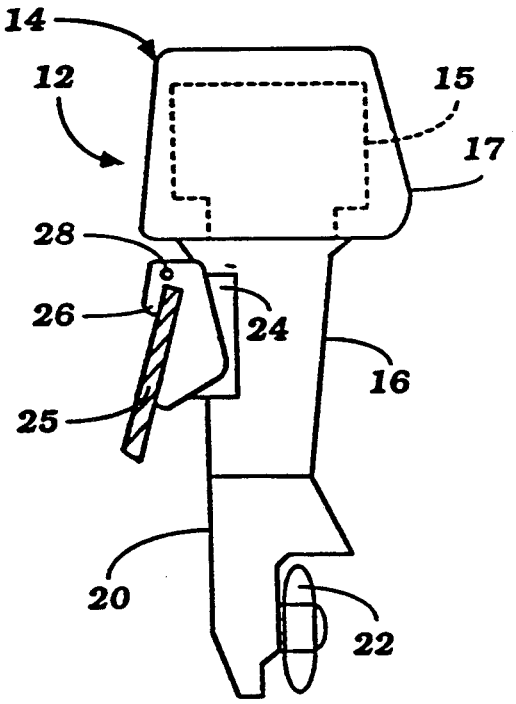
FIG. 1 is a side elevational view of an outboard motor constructed in accordance with the invention, partially shown in phantom.

Referring first primarily to FIG. 1, an outboard motor constructed in accordance with this invention is identified generally by the reference numeral 12. The motor 12, includes a power head, indicated generally by the reference numeral 14, which includes a water cooled internal combustion engine 15, shown in phantom, and a surrounding protective cowling 17. A drive shaft housing 16 depends from the power head 14 and rotatably supports a drive shaft (not shown) that is driven in a known manner by the engine 15. A lower unit 20 is positioned beneath the drive shaft housing 16 and includes a forward, neutral, reverse transmission system (not shown) for driving a propeller 22.

The outboard motor 12 is adapted to be affixed to the transom 25 of an associated watercraft for steering about a generally vertically extending axis and for tilting about a generally horizontally extending axis by means of a mounting assembly, which is described next.

A steering shaft (not shown) is affixed to the drive shaft housing 16 and is rotatably journalled in a swivel bracket 24. This rotational movement accommodates steering of the outboard motor 12 about a vertically extending axis defined by the axis of rotation of the steering shaft within the swivel bracket 24.

The swivel bracket 24 is, in turn, pivotally connected to a clamping bracket 26 by means of a pivot pin 28. This pivotal connection permits tilting of the outboard motor 12 about the horizontally disposed axis defined by the pivot pin 28 for trim adjustment and so that the outboard motor 12 may be tilted up to an out of the water condition during trailering and when not in use. The clamping bracket 26 carries a clamping device (not shown) so as to permit attachment of the outboard motor 12 to the transom of an associated watercraft.

Figure 2:
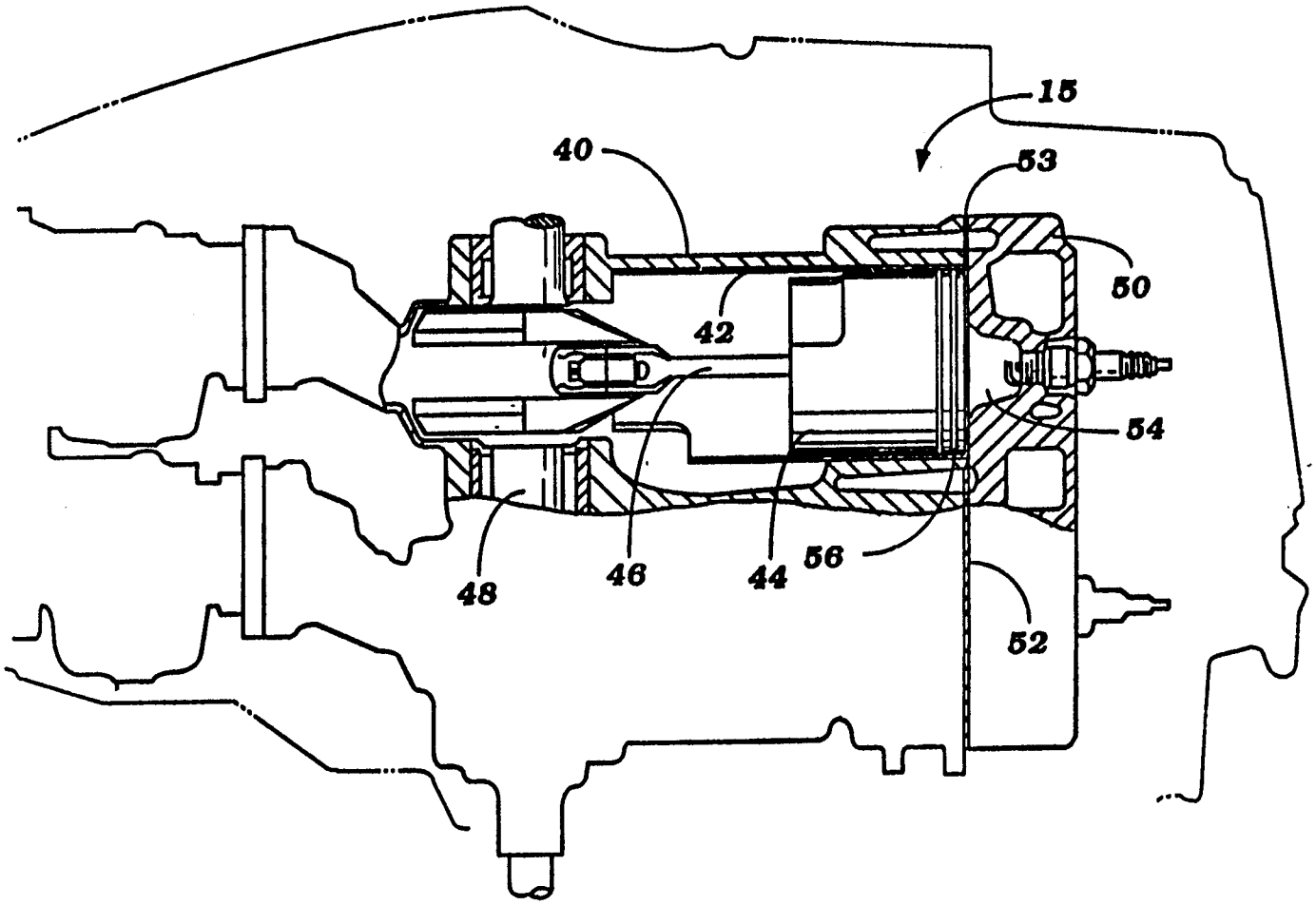
FIG. 2 is an enlarged cross-sectional view taken through a cylinder of an internal combustion engine in accordance with the invention.

Referring now additionally to FIG. 2, the engine 15 is comprised of a cylinder block 40 having one or more cylinder bores in which sleeves, indicated generally by the reference numeral 42 are positioned. A piston 44 reciprocates within the sleeve 42 and is connected by means of a connecting rod 46 to drive a crankshaft 48 in a known manner.

A cylinder head 50 is affixed to the cylinder block 40 in an appropriate manner with a cylinder head gasket 52 being interposed along a mating surface 53 between the cylinder head 50 and cylinder block 40 for sealing the cylinder bores in a known manner. A combustion chamber 54 is thus formed between the head of the piston 44, the cylinder bore formed by the sleeve 42 and the cylinder head 50 which is sealed by the cylinder head gasket 52. Piston rings 56 are fixed in grooves in the piston 44 for effecting a sliding seal with the internal surface of the sleeve 42.

It is believed that further description of the machine per se is not necessary to permit those skilled in the art to understand how the invention is practiced. However, it should be noted that, in accordance with the invention, the cylinder sleeve 42 is provided with a plated inner surface. It should also be noted that the invention can also be applied to a cylinder block which does not employ sleeves, but which has bores for accommodating pistons formed within itself. That is to say that the lining of the cylinder bore may be comprised of the base metal of the cylinder block itself. The plating is formed from a more wear resistant material than the sleeve or lining itself, such as chromium for improved wear resistance or nick-a-zir for improved seizure resistance.

Figure 3:
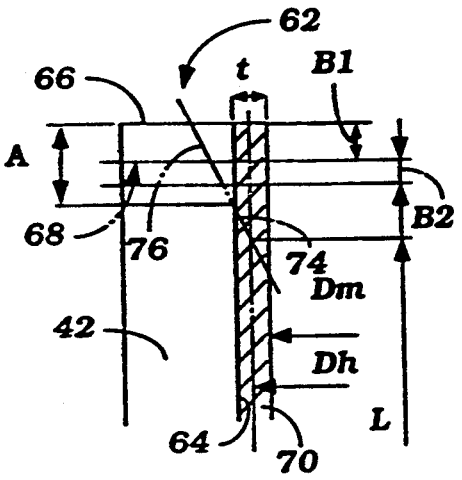
FIG. 3 is a partial cross-sectional view taken through a cylinder sleeve constructed in accordance with the invention.
Figure 4:
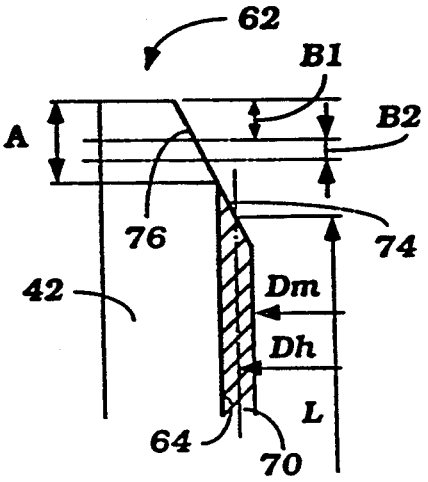
FIG. 4 is a partial cross-sectional view taken through the cylinder sleeve of FIG. 3 after a portion of the sleeve has been chamfered.

As may be readily apparent from FIG. 2, the piston rings 56 do not sweep the full cylinder bore area of the sleeve 42, but instead travel upwardly therein to a distance indicated by the dimension L in FIGS. 3 and 4. This is significant in accordance with the invention, as will now be described.

With additional reference to FIGS. 3 and 4, in forming the cylinder liner in accordance with this invention, the sleeve 42 is formed having an upper end 62 and a sleeve bore 64 portion. As illustrated in FIG. 4, the upper end 62 of the sleeve 42 is initially formed with an end face 66 which represents the end of the sleeve 42, before a machining process is carried out in order to form a suitable mating surface 53 for abutting against the cylinder head 50 and gasket 32 in the assembled engine 15. The mating surface 53, after such a machining process has been carried out, is depicted in FIG. 4 as comprising the end face 68.

In accordance with the invention, a plating material 70 is formed initially to a depth t so as to provide an inner surface 72 that is slightly less than the finished bore diameter of the machine. It should be noted that the plating material 70 covers the complete inner surface of the sleeve bore 64 portion of the sleeve 42.

Next, the upper end 62 of the sleeve bore 64 portion of the sleeve 42 is chamfered through both its base metal portion and its plating layer 70 to form a chamfered bore 74 at the upper end 62. FIG. 3 shows the sleeve 42 before the chamfered bore 74 is formed, and FIG. 4 shows the sleeve 42 after the chamfered bore 74 has been formed.

It is to be noted that the chamfering process leaves an end portion of the chamfered bore non-plated by the plating material 70. This non-plated region is denoted in FIGS. 3 and 4 by the reference numeral 76. In FIG. 3 the dimension A is the chamfering depth of the non-plated region 76 measured from the end face 66 portion of the sleeve 42, before any further machining. The dimension A of the non-plated region 76 is set having a greater depth than the depth allowance required when the mating surface is machined with cutting tools, before or after the sleeve 42 has been fitted into the cylinder block 40, to allow machining of the end of only the sleeve 42 without disturbing the plating 70 while ensuring that the piston rings 56 will still slide only on the plating 70 without contacting the base metal of the sleeve.

The dimensions B1 and B2 in FIGS. 3 and 4 represent examples of machining length allowances required for machining the upper end 62 with cutting tools. Specifically, B1 is an initial machining length allowance required for achieving a proper flushness of the mating surface 53 on a side as formed by the sleeve 42 and the upper end of the cylinder block 40, when the sleeve is first fitted into the cylinder block 40. B2 is a final machining allowance for eliminating any unevenness in the mating surface 53 between the cylinder block/sleeve combination and the cylinder head 50 for replacement sleeves. Upon machining to the depth B1, or to the additional depth B2, the plating 70 will not be acted upon by the machining operation. Further, it should be noted that the plating 70 remains in the area L swept by the piston rings.

The finished bore is then honed from the diameter Dm to the final bore diameter Dh and this removes a portion of the plating 70. As a result of this construction, the end machining will not at all attack or strip away any of the plating layer 70. Thus it will be ensured that the plating will stay in place for the full life of the engine.

It should be readily apparent from the foregoing description that the present invention is particularly effective to provide cylinder bores, and a method of manufacturing them, wherein machining of the end surface will not at all attack and strip away the plating of the inner bore. It should be noted that while a particular description has been provided above, various changes and modifications may be made without departing from the spirit and scope of the invention, as defined by the appended claims.

It is claimed:

1. A method of making a cylinder for a cylinder block of a reciprocating machine comprising the steps of forming a cylinder having an inner surface which comprises an inner bore; coating the inner bore with a wear resistant plating; chamfering off an inner ring of an upper end of said cylinder in a manner to prevent removal of said plating upon machining of said upper end; wherein said chamfering step is carried out upon a region of said inner ridge of said upper end of said cylinder which extends from a location beneath said upper end of said cylinder to a location all of the way up to, and including, an absolute end surface of said cylinder.

2. A method of making a liner for a cylinder as set forth in claim 1 wherein said coating is initially formed on the entire inner surface of said inner bore prior to said chamfering step.

3. A method of making a liner for a cylinder as set forth in claim 2 wherein said coating terminates short of said upper end of said cylinder subsequent to said chamfering step.

4. A method of making a liner for a cylinder as set forth in claim 3 further comprising the step of machining said upper end of said cylinder so that said upper end of said cylinder will be essentially coplanar with an upper end of the cylinder block.

5. A method of making a liner for a cylinder as set forth in claim 4 wherein said coating is formed on said inner bore to a thickness making the inner bore diameter less than a desired finished bore diameter.

6. A method of making a liner for a cylinder as set forth in claim 5 further comprising the step of honing the inner bore of said coating in order to provide said desired finished bore diameter.

7. A method of making a liner for a cylinder as set forth in claim 6 wherein said cylinder is a sleeve comprised of a first material forming the inner bore and a second material forming the coating.

8. A method of making a liner for a cylinder as set forth in claim 6 wherein said cylinder is formed integrally with, and from, the material comprising the cylinder block.

* * * * *

UNITED STATES PATENT AND TRADEMARK OFFICE

CERTIFICATE OF CORRECTION

PATENT NO. : 5,199,166

DATED : April 6, 1993

INVENTOR(S) : Torigai, et al

It is certified that error appears in the above-indentified patent and that said Letters Patent is hereby corrected as shown below:

Column 4, line 46, Claim 1, "ring" should be --ridge--.

Signed and Sealed this

Twenty-ninth Day of March, 1994

*Attest:*

*Attesting Officer*

Bruce Lehman

BRUCE LEHMAN

*Commissioner of Patents and Trademarks*